US005551561A

United States Patent [19]

MacRae et al.

[11] Patent Number: 5,551,561

[45] Date of Patent: Sep. 3, 1996

[54] FULLY ENCLOSED CONVERTIBLE GOLF EQUIPMENT CARRIER

[76] Inventors: Edward G. MacRae, 11 Lancewood Cres., Brampton, Ontario, Canada, L6S 5Y5; John A. Paterson, 354 Clendenan Avenue, Toronto, Ontario, Canada, M6P 2X4; James A. MacRae, 95 Thorncliffe Park Drive, Toronto, Ontario, Canada

[21] Appl. No.: 524,934

[22] Filed: Sep. 8, 1995

Related U.S. Application Data

[63] Continuation of Ser. No. 131,743, Oct. 5, 1993, abandoned.

[51] Int. Cl.[6] ..... A63B 55/00

[52] U.S. Cl. ..... 206/315.3; 206/315.4; 206/315.6; 206/315.8

[58] Field of Search ..... 150/159; 206/315.2–315.6

[56] References Cited

U.S. PATENT DOCUMENTS

| | | | |
|---|---|---|---|
| 1,442,906 | 1/1923 | Rawlings et al. | 206/315.4 |
| 1,597,870 | 8/1926 | Reach | 206/315.6 |
| 1,636,194 | 7/1927 | Mullins . | |
| 1,920,308 | 8/1933 | Hiles | 206/315.6 |
| 1,939,488 | 12/1933 | Dent et al. . | |
| 2,009,072 | 7/1935 | Sampson . | |
| 2,010,166 | 8/1935 | Thompson | 206/315.6 |
| 2,368,095 | 1/1945 | Baylis | 206/315.6 |
| 2,685,317 | 8/1954 | Lace et al. | 206/315.6 |
| 2,732,871 | 1/1956 | Drown | 206/315.3 X |
| 2,739,631 | 3/1956 | Hamley | 206/315.3 X |
| 3,051,130 | 8/1962 | Morris | 224/236 X |
| 3,977,451 | 8/1976 | Duba . | |
| 4,664,382 | 5/1987 | Palmer et al. | 206/315.6 X |
| 4,674,747 | 6/1987 | Mazzocco et al. | 206/315.6 X |
| 4,796,789 | 1/1989 | Willcocks | 206/315.6 X |
| 5,005,623 | 4/1991 | Webster, Jr. | 206/315.4 X |
| 5,217,113 | 6/1993 | Kobayashi | 206/315.3 |

FOREIGN PATENT DOCUMENTS

| | | | |
|---|---|---|---|
| 216723 | 10/1955 | Australia | 206/315.3 |
| 438519 | 5/1912 | France | 206/315.3 |

*Primary Examiner*—Sue A. Weaver

*Attorney, Agent, or Firm*—Jeffrey T. Imai; D. Doak Horne; Arne I. Fors

[57] ABSTRACT

A convertible golf bag has a gusset panel which is invertible between a closing position and a carrying position. In the closing position, the gusset panel is fastenable to the golf bag for closing an open end thereof. In the carrying position, the gusset panel is fastenable to the golf bag at a point spaced from the open end for converting the gusset panel into a shoulder strap.

9 Claims, 5 Drawing Sheets

FULLY ENCLOSED CONVERTIBLE GOLF EQUIPMENT CARRIER

This is a continuation application of application Ser. No. 08/131,743, filed on Oct. 5, 1993 now abandoned.

BACKGROUND OF THE INVENTION

1. Field of the Invention

This invention relates to sporting equipment and more particularly, to a novel golf bag and golf equipment carrier formed into a single unitary bag including provisions for accommodating a variety of playing equipment and accessories normally employed in the game of golf.

2. Description of the Prior Art

In the playing of the game of golf, it has been the customary practice to design, manufacture and sell a tubular golf bag made of a variety of materials, with a solid base and an open top or neck, through which golf clubs are inserted into the bag and out of which the heads and part of the shafts of the golf clubs protrude. The tubular design allows the clubs to be inserted and removed from the bag with ease, but results in the bag being bulky and awkward for transporting by car, van or airplane. Adding to the bulkiness of the conventional golf bag, are pockets sewn along the exterior of the bag for the purpose of storing golf shoes, jackets, balls, gloves etc. During play a tubular design of golf bag has the further disadvantage of resting on one pressure point of the body when carried over the shoulder adding discomfort and awkwardness.

For conventional golf bags it is not customary to enclose the opening at the top of the bag or to enclose the protruding golf clubs while playing. When it becomes necessary to transport or store the golf bag and golf clubs, or in the event of an unexpected rainfall, a separate hood attached to the bag as described in U.S. Pat. No. 5,005,623-A may be placed over the top of the bag and the protruding golf clubs thereby enclosing the clubs. Alternatively, a full bag cover with an external handle may be used to enclose the entire bag and clubs for the purpose of transport or storage. Without a hood or full length cover, there is a risk that the golf clubs would fall out of the bag during transport and thereby become lost or damaged as a result of the golf clubs being exposed to adverse conditions. The limitation of covering the bag and clubs for transportation, storage, or in the event of rain, is that they are restricted to covering the existing traditional tubular shape bag by way of separate detachments.

Other attempts to fully enclose the golf bag for transport have been made. U.S. Pat. No. 4,796,789-A describes a golf bag which is a cylindrical shape bag moulded of rigid plastics enclosed by a semi cylindrical lid section hinged to the chest section. However, this latter approach and other similar innovations restrict construction to the traditional tubular or cylindrical shape, which are constructed of rigid plastics and rely on a hinge mechanism or a separate upper removable compartment to enclose the top of the bag and the protruding clubs and to reveal the club heads when unhinged or removed.

Therefore, a long standing need has existed to provide an alternative construction to the traditional configuration, such alterative design to have as its primary characteristics a unitary fully enclosed bag without hinges or compartments, which is flat sided rather than tubular providing uniformly distributed pressure against the side of the body of the golfer thereby adding comfort when carried over the shoulder, with minimal volume and compact shape for ease of play, transportation, storage and protection and with a convertible feature to allow use as a fully functional golf bag in play mode. The innovation described herein is a novel and unique approach which addresses each of these long-standing needs thereby overcoming the shortcomings of the traditional golf bag design and other more recent innovations.

SUMMARY OF THE INVENTION

The disadvantages of the prior art may be overcome by providing a light weight compact fully enclosed golf bag which is convertible between an enclosed golf bag and a carriable golf bag.

According to one aspect of thc invention, there is provided a golf bag having a panel which is convertible between a closing position and a carrying position. The panel fastenable to each side of the golf bag for closing the bag and fastenable to a top panel for converting to a carrying strap.

According to another aspect of the invention, there is provided a convertible golf bag having an invertible gusset which closes the golf bag and transforms into a padded shoulder strap that enables the bag to be used as a fully functional golf bag during play.

BRIEF DESCRIPTI0N OF THE DRAWINGS

The feature of the present invention which are believed to be novel are set forth with particularity in the appended claims. The present invention, both as to its organisation and manner of operation, together with further objects and advantages thereof, may best be understood by reference to the following description, taken in connection with the accompanying drawings in which:

DESCRIPTION OF THE PREFERRED EMBODIMENT

Figure 1:
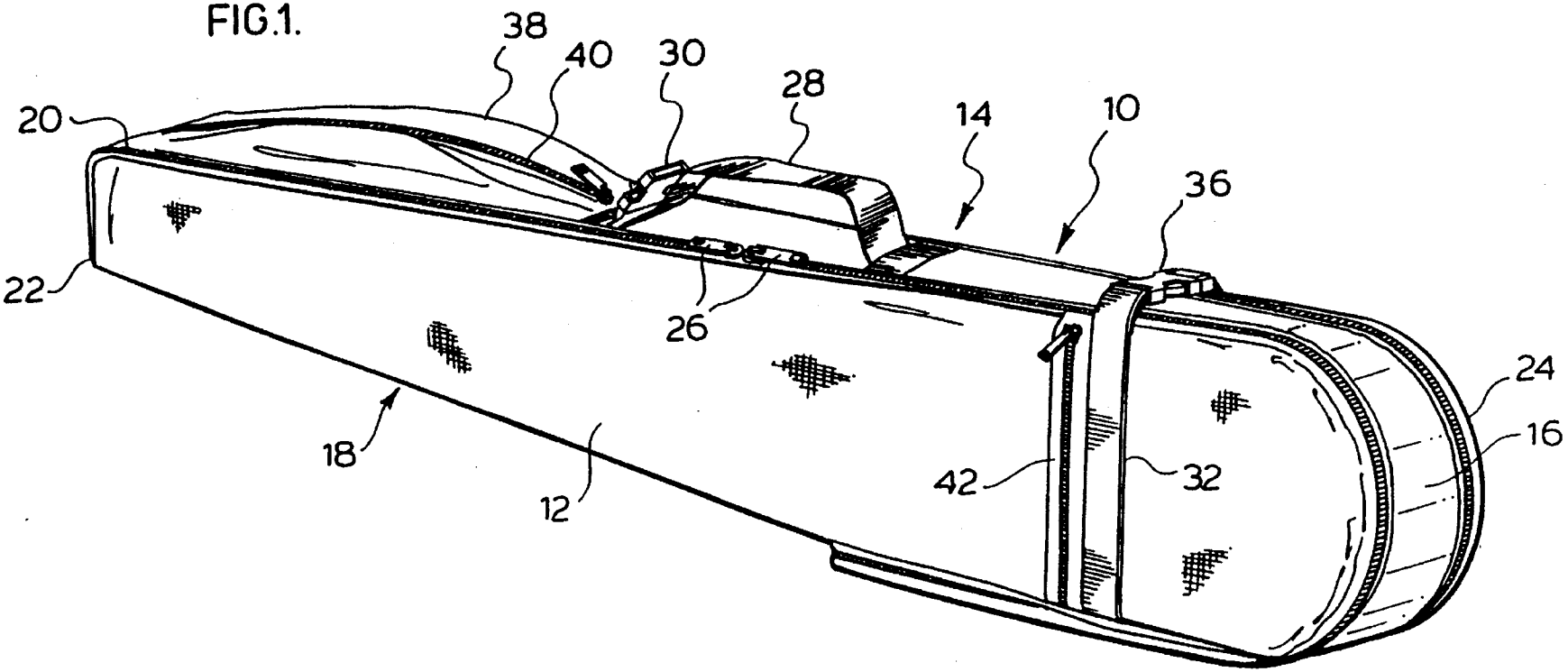
FIG. 1 is a perspective view of the present invention shown from its right side in a closed position showing the carrying handle.
Figure 2:
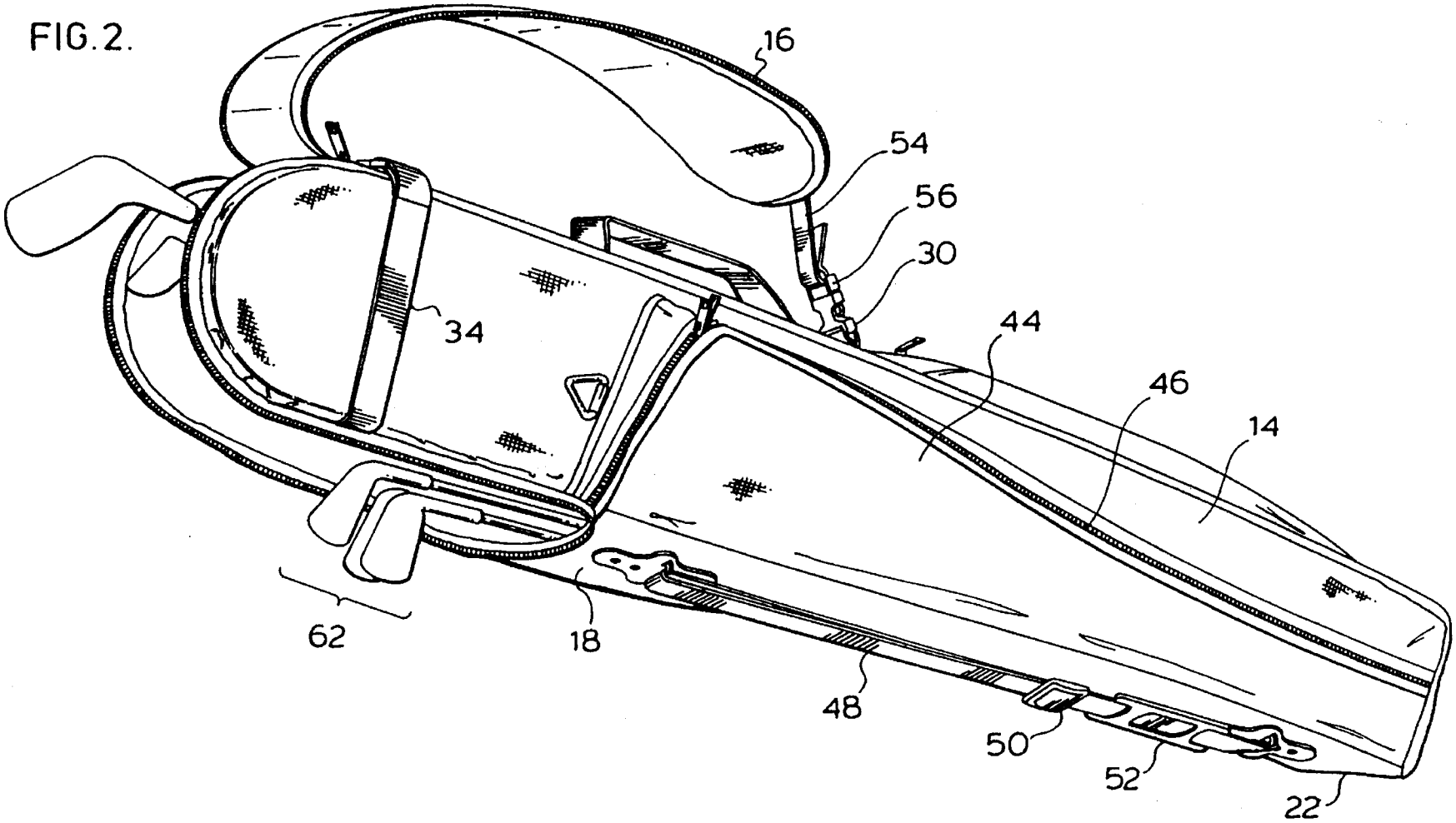
FIG. 2 is a perspective left side view of the invention of FIG. 1 showing the golf bag in a carrying position.

Referring to FIGS. 1 and 2, the golf bag 10 of the present invention is illustrated. Golf bag 10 generally comprises side panels 12 and 14, gusset panel 16 and a bottom panel 18. Gusset 16 is joined to bottom panel 18 at base corner 22. Zipper 20 extends from the base corner 22 of golf bag 10 about the perimeter of side panel 12 about the head end 24 of golf bag 10, back towards the base corner 22, across bottom panel 18 to side panel 14 back around head end 24 of golf bag 10 and back down to the base corner 22. Two zipper cars 26 are used in the present invention.

Side panels 12,14, bottom panel 18 and gusset panel 16 are constructed from soft padded materials which not only protects the golf clubs from damage but also provides comfort when being carried against the body of the golfer.

The panels of golf bag 10 define a hollow compartment for storing golf clubs and an open end for receiving and extracting golf clubs during play. Golf bag 10 is contoured to a shape to accommodate the various golf clubs. The golf bag 10 has the narrow end which stores the cluster of golf club handles and a wider end for the golf club heads.

Gusset panel 16 is provided with a handle 28 and positioned approximately at the centre of balance of the golf bag 10 when loaded with golf clubs. Spaced towards the base corner 22 is a receiving end buckle 30 of a conventional plastic buckle. Spaced towards the head end 24 of golf bag 10 is strap 32 which is affixed to side panel 12. Similarly, strap 34 is affixed to side panel 14. At the ends of strap 32 and 34 are complimentary ends of buckle 36.

Gusset 16 is provided with a spine or structural member extending along the upper portion of gusset panel 16. The spine adds rigidity to the golf bag 10.

Optionally, gusset panel 16 can be provided with a pocket 38 having a zipper 40 for opening and closing the pocket. Further, side panel 12 is provided with an internal pocket which is accessed through zipper 42. Side panel 14 has pocket 44 which is accessed through zipper 46.

To maximize cost efficiency and weight reduction, an internal pocket can be used to store specific clubs or accessories, such as a number one wood or golf ball retriever. If the woods are placed in the internal pocket through zipper 42, the pocket separates the woods from the shorter length irons when in play mode as in FIG. 2. Optionally, straps or other well known devices for separating individual golf clubs may also be employed with the present invention.

Bottom panel 18 is provided with a detachable and adjustable strap 48. Strap 48 is adjusted by movement of buckle 50 in a well known manner. Adjustable strap 48 is also provided with a shoulder pad 52.

The inside edge of the remote end of gusset 16 has a strap 54 having a complementary end buckle 56, complementary to receiving end buckle 30.

Figure 3:
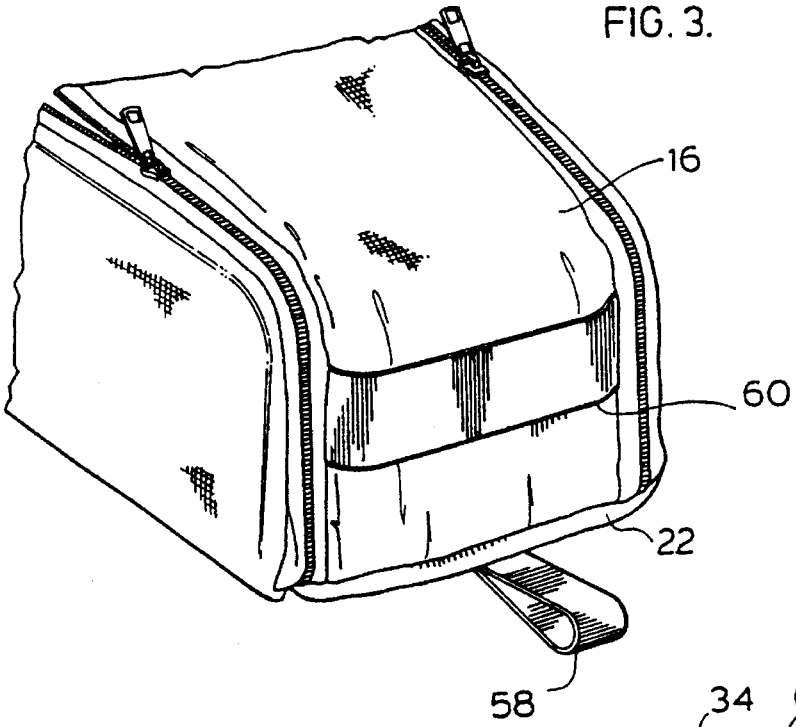
FIG. 3 is a perspective view of a ban end of the invention of FIG. 1.

Referring to FIG. 3, base corner 22 has a hang up tab 58 and a securing strap 60. The securing strap 60 provides a means by which the base of the bag can be secured to a pull-cart, a common mode to transport clubs on a golf course during play.

The length of side panels 12,14 exceeds the length of The longest club which is used in a normal round of golf. Bottom panel 18 has a length approximately equal to the shaft length of the shortest club of the conventional golf set.

The side panels 12,14 of the golf bag 10 are generally flat along the full length thereof, rather than tubular. This arrangement is particularly advantageous as it provides uniformly distributed pressure against the side of the body of the golfer when carried over the shoulder for play or transport. This arrangement provides more comfort than a tangential pressure point as with a conventional tubular golf bag.

Figure 5:
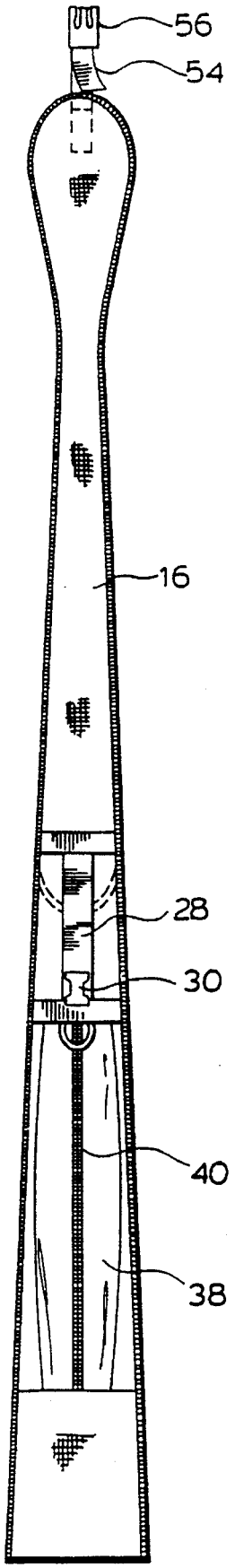
FIG. 5 is a top plan view of the invention of FIG. 1.

Referring to FIG. 5, the shape of the gusset panel 16 is illustrated. The gusset panel 16 has additional padded material along the length thereof. The width of the gusset panel 16 is sized to accommodate with some allowance, the number of clubs intended to be carded. The gusset narrows at an intermediate point where the gusset panel 16 is intended to rest on the shoulder of the golfer in play mode thereby providing comfort and preventing the inverted gusset panel 16 from slipping off the shoulder of the golfer.

FIG. 1 illustrates the golf bag 10 in a closed condition. The two zipper cars 26 are together closing golf bag 10 for storing golf clubs 62 therein. To convert the golf bag 10 into the carrying position, the zipper cars 26 are moved away from each other until each is on an opposite side of the golf bag 10, but both in the region of strap 32,34. The remote end of gusset 16 is now released and able to be retracted and folded over itself until complementary end buckle 56 can be inserted into receiving end buckle 30, presenting a shoulder strap for carrying the golf bag. In this position, golf clubs 62 are free to hang and extend out through the open end of the body of the golf bag 10 and may be withdrawn for play. It is noted that buckle 36 is maintained in a closed condition securing zipper cars 26 and preventing them from further travelling down the length of the zipper 20.

Figure 4:
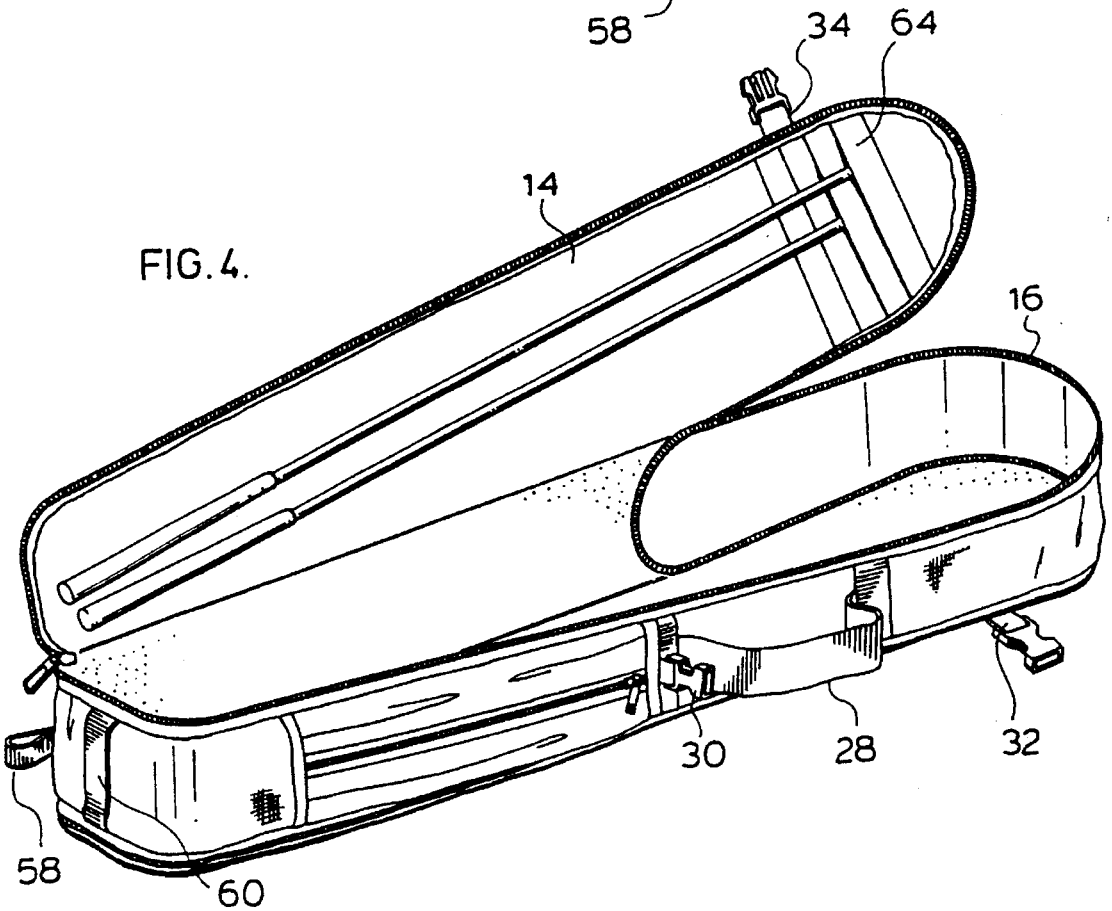
FIG. 4 is a perspective view of the invention of FIG. 1 with one side open and club heads nested in storage pockets.

Referring to FIG. 4, golf bag 10 is illustrated in a fully open position. The inside panel of either side panel 12, 14 is provided with a series of nesting pockets 64. Zipper cars 26 are moved about zipper 20 until only one of either side panels 12 and 14 is released and allot, red to move in a hinged relation. Buckle 36 is released allowing either side panel 12, 14 to be opened exposing nesting pockets 64.

In order to prepare the clubs for transport, the heads of each club may be inserted into the nesting pockets 64. The shafts of the clubs fit back within the compartment, which can be then fully enclosed for transportation and storage as illustrated in FIG. 1. By inserting each of the golf clubs 62 into the nesting pockets 64, the heads of the clubs are protected from damage from each other. Once the head of each of the golf clubs 62 has been inserted into the nesting pockets 64, the side panel 12, 14 may be closed and the zipper cars 26 may be moved together closing the golf bag 10.

Figure 6:
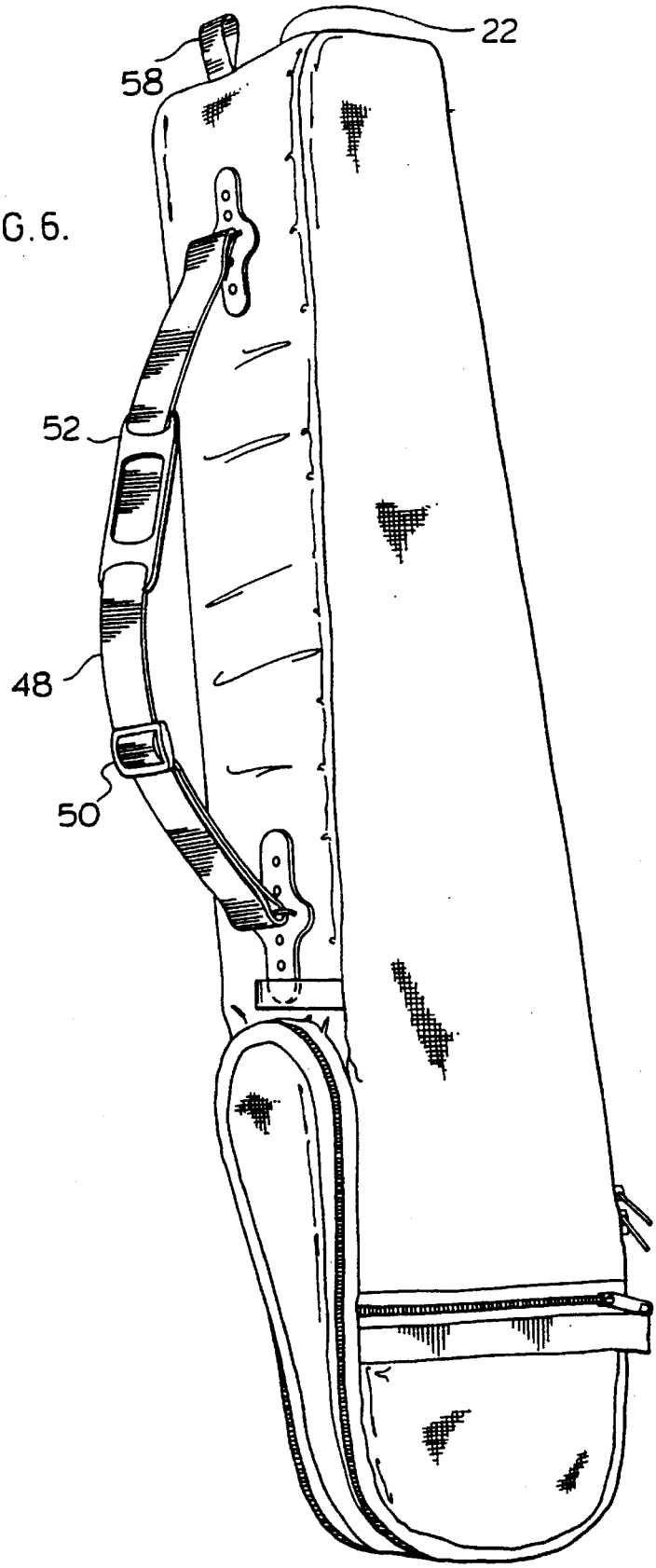
FIG. 6 is a perspective view of the invention of FIG. 1 illustrating the golf bag inverted for shoulder-carrying in a closed position with a detachable carrying strap.

Once the golf bag 10 is in a transport ready condition, the golf bag may be carried using handle 28. Optionally, strap 48 may be extended by moving buckle 50 therealong. Shoulder pad 52 is moved towards the base edge 22 allowing the golf bag to be carried in an inverted manner as illustrated in FIG 6. This particular position is particularly advantageous, as the centre of gravity of the golf clubs will be lower than carrying a traditional golf bag. This inverted position provides a unique, stable and comfortable method of carrying golf clubs. The golf bag may be stored in the inverted position by hanging the golf bag from hanging tab 58.

The present invention illustrates the use of conventional releasable and reusable fasteners such as zippers and buckles. It is well known to substitute these fasteners for other types of fasteners such as hook and loop fasteners, snaps or domed fasteners. All such fasteners arc intended to be within the scope of this invention.

While particular embodiments of the present invention have been shown and described, it will be obvious to those skilled in the art that changes and modifications may be made without departing from this invention or restricting the generally in its broader aspects and, therefore, the aim in the appended claims is to cover all such changes and modifications as fall within the true spirit and scope of this invention.

The embodiments of the invention in which we claim an exclusive property or privilege are defined as follows:

1. A convertible golf bag having an open end for receiving and storing golf equipment, an elongate gusset panel sized to extend over and cover said open end, a first fastening means for releasably fastening said gusset panel about said open end, and a second fastening means for releasably fastening a remote end of said gusset panel to said golf bag at a point spaced from said open end; said gusset panel joined to said golf bag and is foldable between a closing position and a carrying position, said closing position characterized by said gusset panel being releasably fastened about said open end closing the open end and said carrying position characterized by said remote end of said gusset panel being folded over and releasably fastened to said golf bag at said point converting said gusset panel into a carrying strap.

2. A convertible golf bag as claimed in claim 1 wherein said golf bag has a second carrying strap for carrying said golf bag in an inverted closed condition.

3. A golf bag as claimed in claim 2 wherein said golf bag further comprises a spine member for longitudinally stiffening said golf bag.

4. A convertible golf bag comprising:

a longitudinal hollow body having an open end for receiving and storing golf clubs therein, said body having two spaced side panels joined to a bottom panel along a pair of longitudinal edges thereof, a longitudinal gusset having a first end and a second end, said first end affixed to an end of the bottom panel, a first fastening means, including a zipper for releasably joining a portion of said gusset about side panels to define said open end and for releasably joining a remaining portion of said gusset about said open end for closing said golf bag, a second fastening means, including a buckle for releasably joining said second end to said body at a point spaced from said open end for presenting a carrying strap.

5. A golf bag as claimed in claim 4 wherein said golf bag further comprises a spine member for longitudinally stiffening said golf bag.

6. A convertible golf bag comprising at least two elongated side panels, said side panels having a length of a longest golf club of a convectional golf set, said side panels having means for joining said side panels together in a hinged relation along a longitudinal edge of said side panels from an end of said side panels for a distance of approximately a length of a shaft of a shortest golf club of a conventional golf set, and an elongated gusset panel having length for extending about a perimeter of said side panels opposite where said side panels are hinged together, said gusset panel having a first end joined to said at least two side panels at said end of said side panels, a first fastening means for releasably fastening said at least two side panels and said gusset panel together defining a compartment for storing golf clubs, for selectively opening and closing an end of said compartment for receiving and storing golf clubs, and for releasing either of said at least two side panels for hingedly opening a side of said compartment, a second fastening means for releasably joining said gusset panel to said golf bag when said gusset panel is in a folded over condition presenting a carrying strap when said end of said compartment is an open condition, and securing means for securing said first fastening means preventing said first fastening means from opening while said gusset is presented as a carrying strap.

7. A convertible golf bag as claimed in claim 6 wherein said first fastening means is a zipper and said second fastening means is a buckle.

8. A convertible golf bag as claimed in claim 7 wherein said securing means is a strap releasably extending from one of said at least two side panels to the other of said at least two side panels, said strap connectable over said gusset panel preventing relative movement between said gusset panel and said at least two side panels when said golf bag is supported by the carrying strap.

9. A golf bag as claimed in claim 8 wherein said golf bag further comprises a spine member for longitudinally stiffening said golf bag.

* * * * *